US005895168A

United States Patent [19]

Liao

[11] Patent Number: 5,895,168

[45] Date of Patent: Apr. 20, 1999

[54] BEATER HOLDER MOUNTING STRUCTURE

[75] Inventor: Tsun-Chi Liao, Taichung, Taiwan

[73] Assignee: HWA Shin Musical Instrument Co., Ltd., Taichung, Taiwan

[21] Appl. No.: 09/099,442

[22] Filed: Jun. 18, 1998

[51] Int. Cl.[6] ..... B25G 3/02

[52] U.S. Cl. ..... 403/362; 84/422.1

[58] Field of Search ..... 403/362, 383, 403/375, 373, 335, 336; 84/422.1

[56] References Cited

U.S. PATENT DOCUMENTS 4,186,644 2/1980 Kurosaki ..... 84/422.1

5,714,701 2/1998 Hsieh ..... 84/422.1

*Primary Examiner*—Anthony Knight
*Assistant Examiner*—David Bochna
*Attorney, Agent, or Firm*—Bacon & Thomas, PLLC

[57] ABSTRACT

A beater holder mounting structure includes a holder base fixedly fastened to a polygonal shaft of a pedal unit of a base drum, and a retainer block hooked up with the holder base to secure the stem of a beater to the holder base, the holder base and the retainer block each have a multiple-face through hole nto which the stem of the beater is inserted and fixed by tightening up screws.

5 Claims, 6 Drawing Sheets

BEATER HOLDER MOUNTING STRUCTURE

BACKGROUND OF THE INVENTION

The present invention relates to a beater holder mounting structure used in a base drum to hold a beater, and more particularly to such a beater holder mounting structure which positively secures the beater to the polygonal shaft of the pedal unit of the base drum.

A pedal unit for a base drum, as shown in FIG. 1, is comprised of a base frame, a polygonal shaft revolvably supported between two upright supports raised from the base frame, a beater holder fastened to the polygonal shaft to hold a beater, spring means coupled between one end of the polygonal shaft and the base frame, and a pedal having a rear end hinged to the base frame and a front end coupled to the beater holder by a chain transmission. Referring to FIG. 2 and FIG. 1, the beater holder has a circular axle hole which receives the stem of the beater, and a screw hole perpendicularly extended from the axle hole to the periphery into which a tightening up screw is threaded and stopped against the periphery of the stem of the beater to fix the beater to the beater holder. When installed, the stem of the beater provide two friction resisting surfaces, one at the end of the tightening up screw and the other at the periphery of the circular axle hole opposite to the tightening up screw. Because the two friction resisting surfaces are spaced at about 180°, they are not insufficient to positively secure the stem of the beater to the beater holder. When beating, the beater is vibrated, and may be forced by the vibration force out of position. If the beater is not positively secured in position, the face of the drum may be damaged by the beater.

SUMMARY OF THE INVENTION

The present invention has been accomplished to provide a beater holder mounting structure which eliminates the aforesaid problem. According to the present invention, the beater holder mounting structure is fastened to a polygonal shaft of a pedal unit of a base drum to hold a beater, comprising a holder base having a shaft holder section at one end and a beater holder section at an opposite end, the beater holder section having a beater holding through hole, which receives the stem of the beater, and a screw hole perpendicularly extended from the beater holding through hole to the periphery into which a tightening up screw is threaded and stopped against the stem of the beater, wherein the beater holding through hole is a multiple-face through hole; the beater holder section has a coupling groove at one side thereof; a retainer block is coupled to the coupling groove to hold down the stem of the beater, the retainer block comprising a L-shaped coupling flange extended from a rear side thereof and engaged into the coupling groove of the beater holder section, a vertical multiple-face through hole in alignment with the beater holding through hole of the beater holder section through which the stem of the beater passes, and a horizontal screw hole perpendicularly extended from the vertical multiple-face through hole to the periphery, and a tightening up screw threaded into the horizontal screw hole and stopped against the stem of the beater to fix the stem in place.

DETAILED DESCRIPTION OF THE PREFERRED EMBODIMENT

Figure 1:
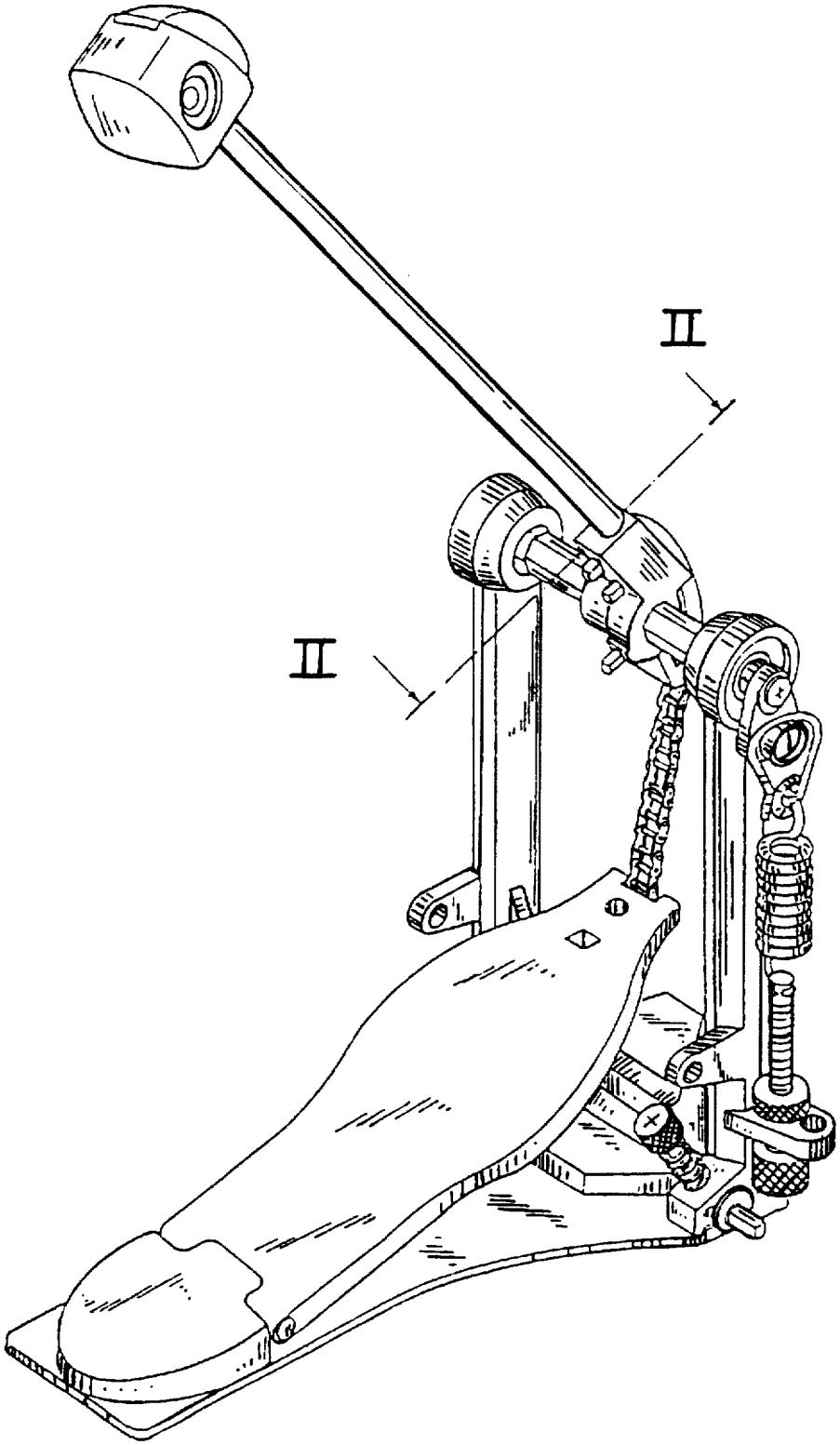
Fig. 1 PRIOR ART
FIG. 1 is a perspective view of a pedal unit for a base drum according to the prior art.
Figure 2:
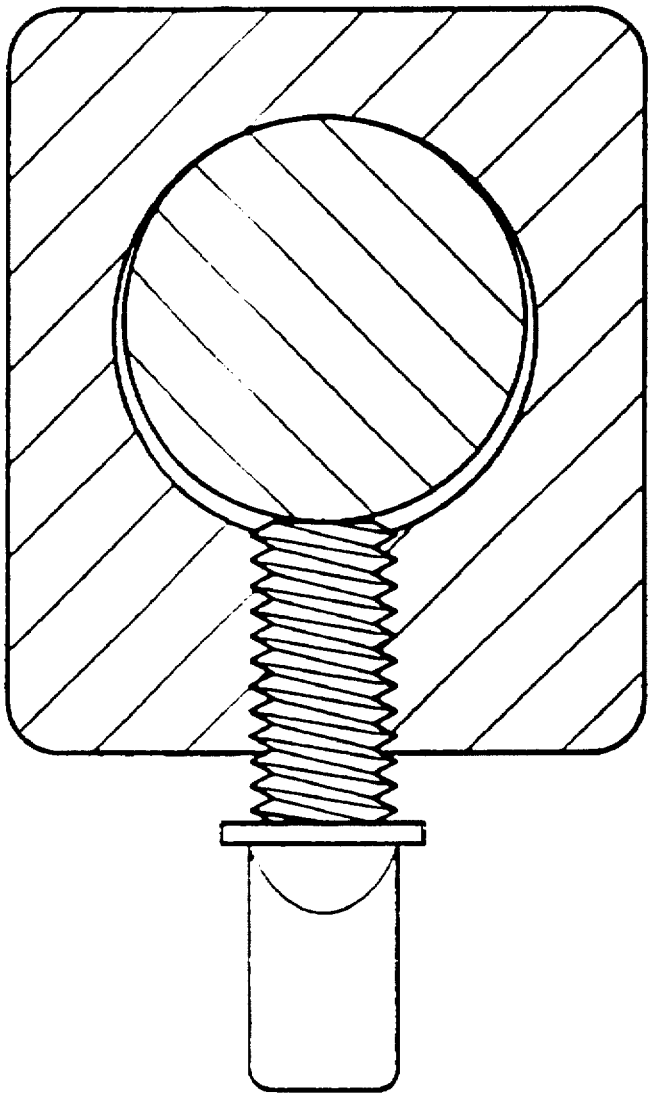
Fig. 2 PRIOR ART
FIG. 2 is a sectional view in an enlarged scale taken along line II—II of FIG. 1.
Figure 3:
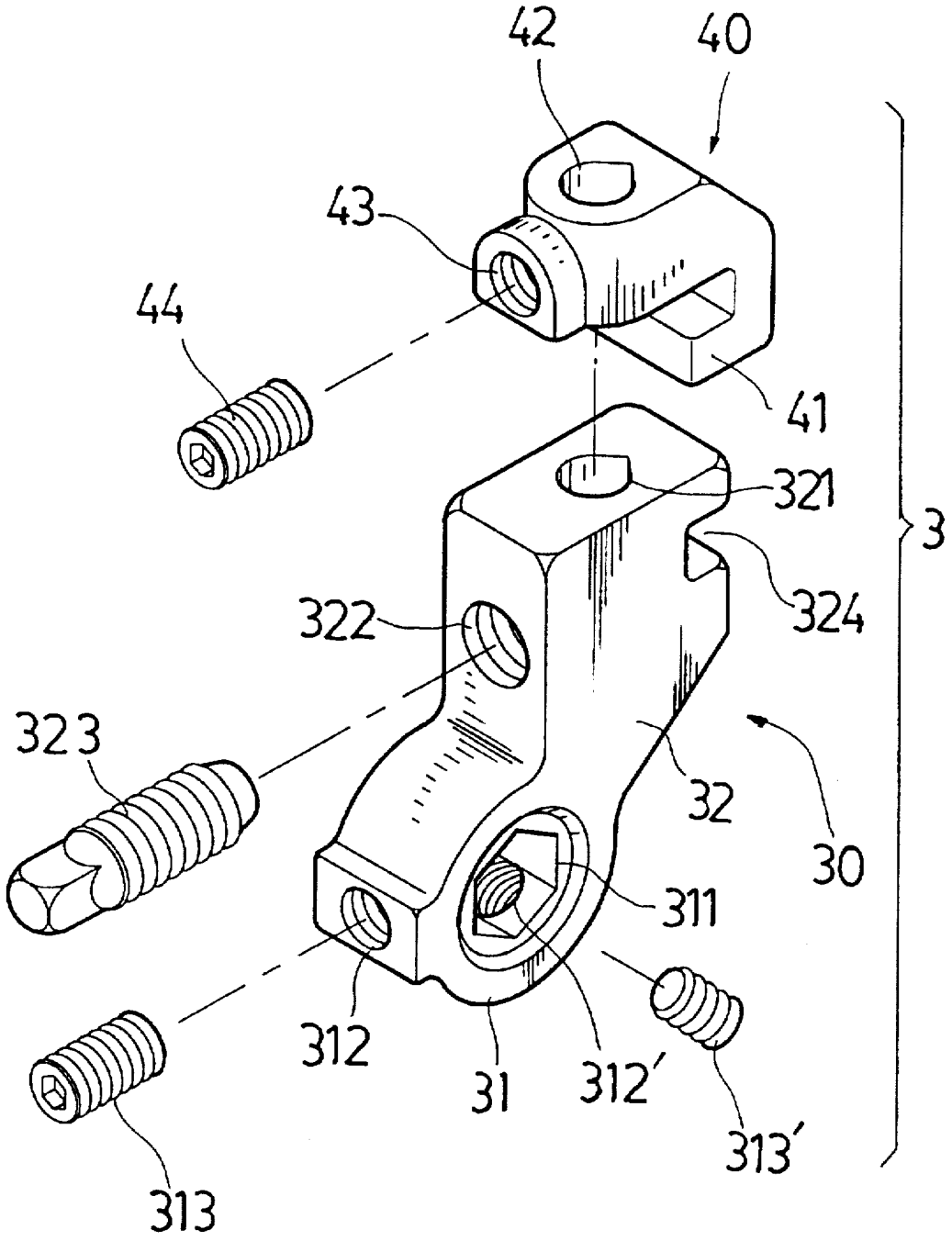
FIG. 3 is an exploded view of a beater holder mounting structure according to the present invention.
Figure 4:
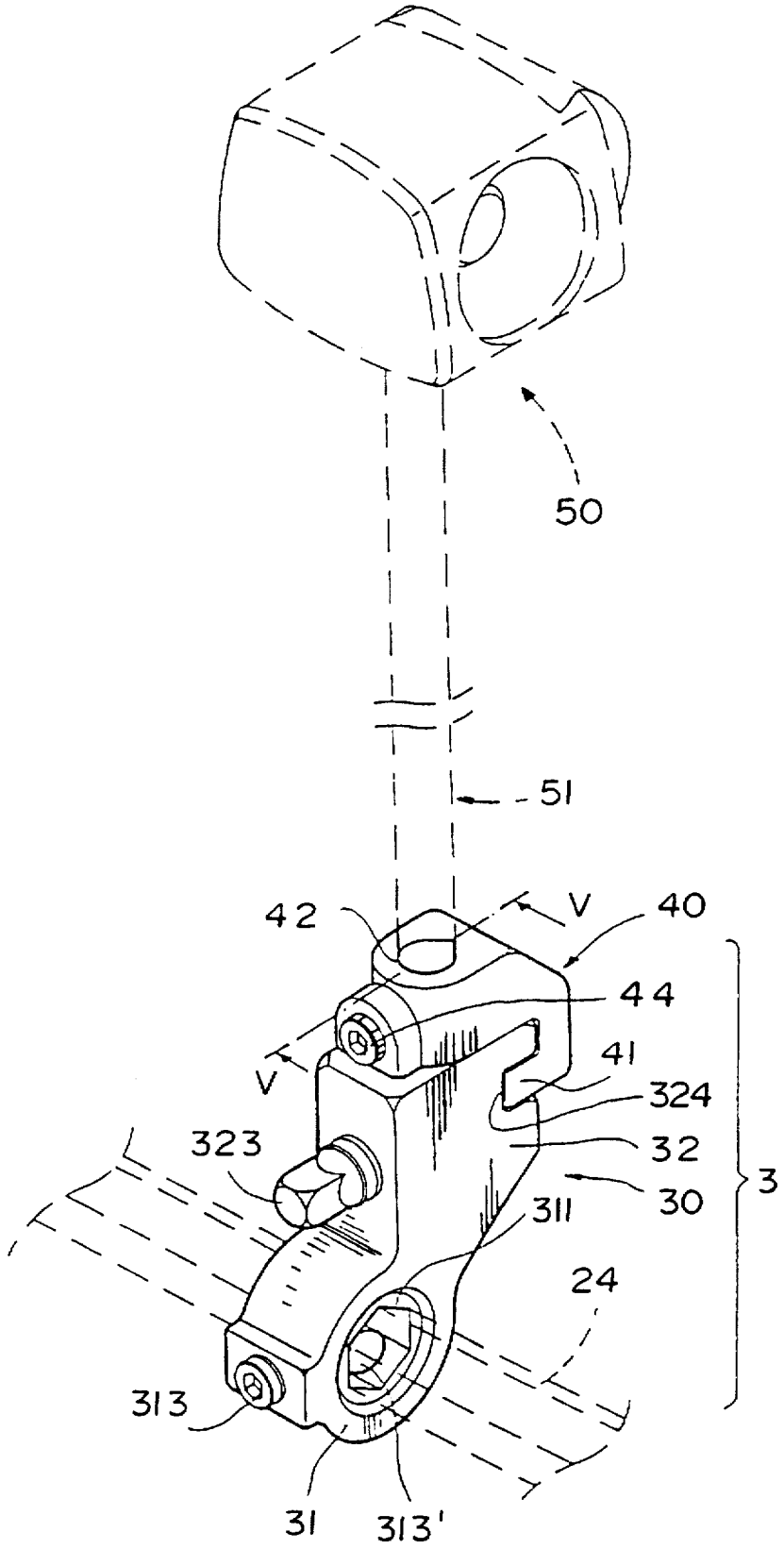
FIG. 4 is an installed view of the present invention.
Figure 5:
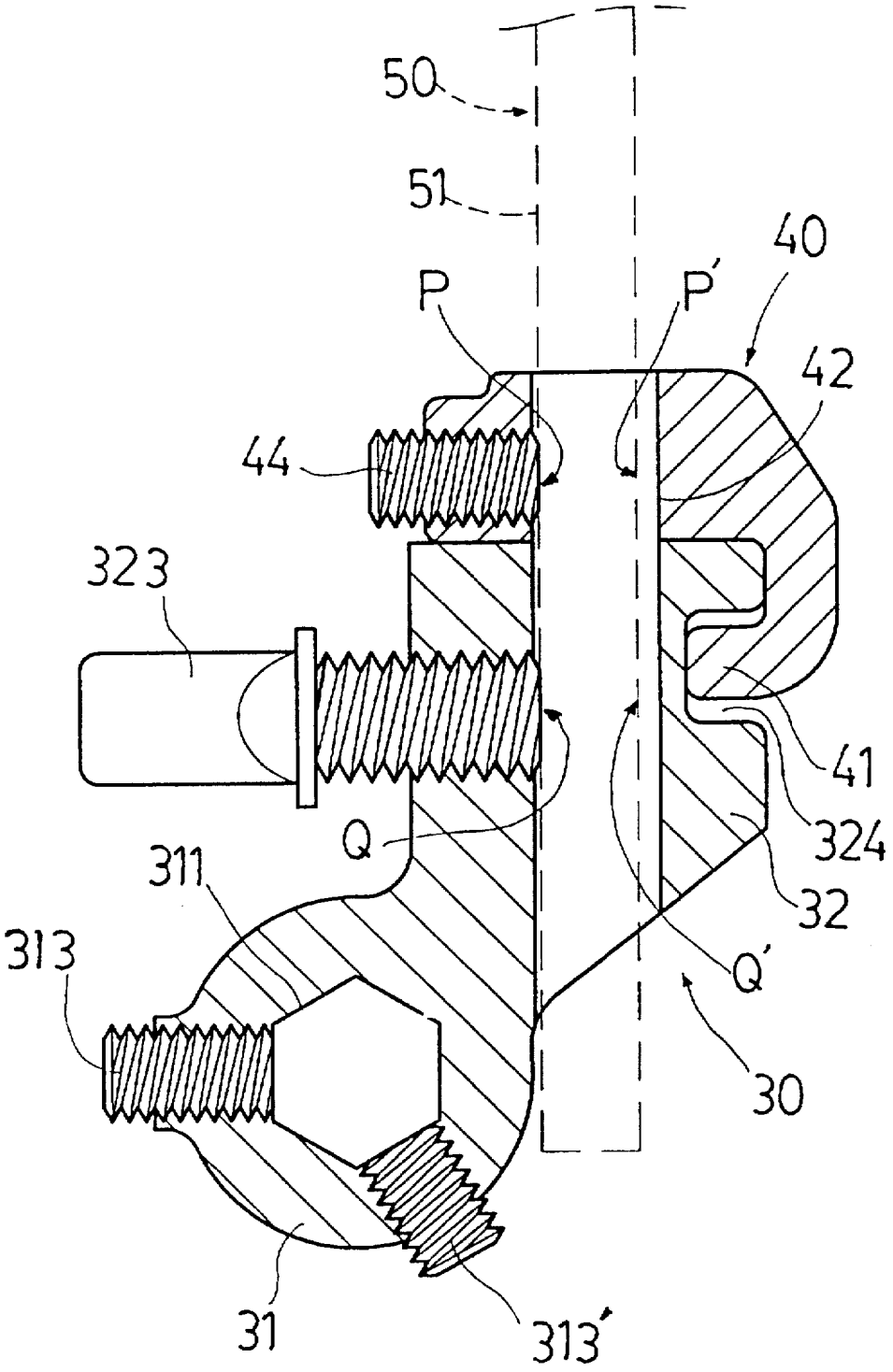
FIG. 5 is a sectional view in an enlarged scale taken along line V—V of FIG. 4.

Referring to FIGS. 3, 4 and 5, a beater holder 3 is shown comprised of a holder base 30, and a retainer block 40.

The holder base 30 is a substantially L-shaped block having a shaft holder section 31 at one end and a beater holder section 32 at an opposite end. The shaft holder section 31 comprises a transversely extended polygonal through hole 311, which receives the polygonal shaft 24 of a pedal assembly (not shown), two screw holes 312:312' radially extended from the polygonal through hole 311 to the periphery in different directions. Two tightening up screws 313:313' are respectively threaded into the screw holes 312:312' on the shaft holder section 31 and stopped against the periphery of the polygonal shaft 24, enabling the polygonal shaft 24 to be fixedly secured to the shaft holder section 31. The beater holder section 32 comprises a longitudinally extended multiple-face through hole 321, which receives the stem 51 of a beater 50, one transverse screw hole 322 perpendicularly extended from the longitudinally extended through hole 321 to the periphery into which a tightening up screw 323 is threaded and stopped against the stem 51 of the beater 50 to fix the stem 51 in place, and a coupling groove 324 at one side opposite to the screw hole 322.

The retainer block 40 is coupled to the beater holder section 32 of the holder base 30 at the top, comprising a L-shaped coupling flange 41 engaged into the coupling groove 324 on the beater holder section 32 of the holder base 30, a vertical multipleface through hole 42 in alignment with the longitudinally extended through hole 321 on the beater holder section 32 of the holder base 30 through which the stem 51 of the beater 50 passes, and a horizontal screw hole 43 perpendicularly extended from the vertical through hole 42 to the periphery into which a tightening up screw 44 is threaded and stopped against the stem 51 of the beater 50 to fix the stem 51 in place. The longitudinally extended through hole 321 on the beater holder section 32 of the holder base 30 and the vertical through hole 42 on the retainer block 40 have a water drip-like cross section. This design enables the stem 51 of the beater 50 to be fixedly secured to the holder base 30 and the retainer block 40 by the tightening up screws 323:44. When the tightening up screw 44 is threaded into the screw hole 43 and fastened tight, the retainer block 40 is simultaneously pulled toward the tightening up screw 44, causing the L-shaped coupling flange 41 of the retainer block 40 to be tightly engaged with the coupling groove 324 on the beater holder section 32 of the holder base 30, and therefore the stem 51 of the beater 50 is held down.

Figure 6:
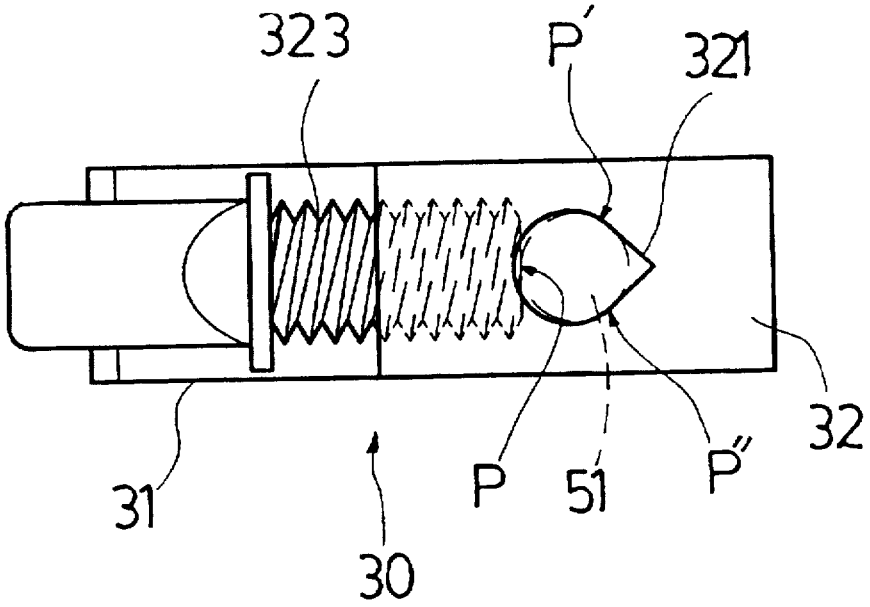
FIG. 6 is a top plain view of the holder base according to the present invention.
Figure 7:
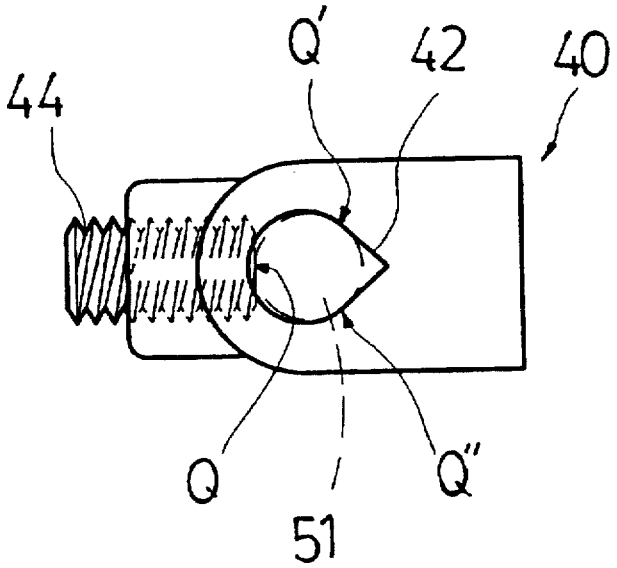
FIG. 7 is a top plain view of the retainer block according to the present invention.

Referring to FIGS. 6 and 7, when the tightening up screws 323:44 are stopped against the stem 51, a plurality of friction resisting surfaces P:P':P":Q:Q':Q" are produced between the periphery of the stem 51, the periphery of the through hole 321:42 and the ends of the tightening up screws 323:44.

Referring to FIG. 6, the friction resisting surfaces P:P':P" are produced between the stem 51, the through hole 321 and the tightening up screw 323. The friction resisting surface P is produced between the tightening up screw 323 and the stem 51. The friction resisting surfaces P':P" are produced between the stem 51 and the periphery of the through hole 321 around the tip area of the water drip-like cross section. Because the beater holder section 32 has an elongated shape, the friction resisting surfaces P:P':P" are narrow, elongated surfaces. Therefore, much friction resistance is produced to hold down the stem 51 in position.

Referring to FIG. 7, the friction resisting surfaces Q:Q':Q" are produced between the stem 51, the through hole 42 and the tightening up screw 44. The friction resisting surface Q is produced between the stem 51 and the tightening up screw 44. The friction resisting surfaces Q':Q" are produced between the stem 51 and the periphery of the through hole 42 around the tip area of the water drip-like cross section. Because the retainer block 40 has a certain thickness, the friction resisting surfaces P:P':P" are extended to a certain length. Therefore, much friction resistance is produced to hold down the stem 51 in position.

As indicated above, a plurality of friction resisting surfaces P:P':P":Q:Q':Q" are produced between the periphery of the stem 51, the periphery of the through hole 321:42 and the ends of the tightening up screws 323:44, therefore the beater 50 is firmly secured to the beater holder 3, and positively turned with the beater holder 3 when the polygonal shaft 24 is turned back and forth.

What we claim is:

1. A beater holder mounting structure fastened to a polygonal shaft of a pedal unit of a base drum to hold a beater, comprising a holder base having a shaft holder section at one end and a beater holder section at an opposite end, said beater holder section having a beater holding through hole, which receives the stem of the beater, and a screw hole perpendicularly extended from said beater holding through hole to the periphery into which a tightening up screw is threaded and stopped against the stem of the beater, wherein:

said beater holding through hole is a multiple-face through hole;

said beater holder section has a coupling groove at one side thereof;

a retainer block is coupled to said coupling groove to hold down the stem of the beater, said retainer block comprising a L-shaped coupling flange extended from a rear side thereof and engaged into said coupling groove of said beater holder section, a vertical multiple-face through hole in alignment with said beater holding through hole of said beater holder section through which the stem of the beater passes, and a horizontal screw hole perpendicularly extended from said vertical multiple-face through hole to the periphery, and a tightening up screw threaded into said horizontal screw hole and stopped against the stem of said beater to fix the stem in place.

2. The beater holder mounting structure of claim 1, wherein said beater holding through hole has a cross section shaped like a water drip.

3. The beater holder mounting structure of claim 1, wherein the stem of the beater provide at least three friction resisting surfaces with said holder base, including a friction resisting surface between the periphery of the stem and the tightening up screw in the screw hole on said beater holder section, and at least two friction resisting surfaces between the periphery of the stem and the periphery of said beat holding through hole.

4. The beater holder mounting structure of claim 1, wherein said vertical multiple-face through hole of said retainer block has a cross section shaped like a water drip.

5. The beater holder mounting structure of claim 1, wherein the stem of the beater provide at least three friction resisting surfaces with said retainer block, including a friction resisting surface between the periphery of the stem and the tightening up screw in the horizontal screw hole on said retainer block, and at least two friction resisting surfaces between the periphery of the stem and the periphery of said vertical multiple-face through hole on said retainer block.

* * * * *